United States Patent [19]

Holland

[11] Patent Number: 4,976,338

[45] Date of Patent: Dec. 11, 1990

[54] LEVELING CONTROL SYSTEM FOR HYDRAULIC ELEVATOR

[75] Inventor: Gordon A. Holland, DeSoto County, Miss.

[73] Assignee: Delaware Capital Formation, Inc., Wilmington, Del.

[21] Appl. No.: 344,319

[22] Filed: Apr. 27, 1989

[51] Int. Cl.[5] ..... B66B 1/04

[52] U.S. Cl. ..... 187/110; 187/113

[58] Field of Search ..... 187/110, 111, 113

[56] References Cited

U.S. PATENT DOCUMENTS

| | | | |
|---|---|---|---|
| 3,138,223 | 6/1964 | Keiper et al. | 187/113 |
| 3,240,290 | 3/1966 | Pohlman | 187/113 |
| 3,587,785 | 6/1971 | Krauer | 187/105 |
| 3,749,203 | 7/1973 | Hoelscher | 187/113 |
| 3,955,649 | 5/1976 | Takenoshita et al. | 187/110 |
| 3,955,649 | 5/1976 | Takenoshita | 187/110 |
| 4,162,718 | 7/1979 | Lamprey | 187/110 |
| 4,245,721 | 1/1981 | Masel | 187/134 |
| 4,337,846 | 7/1982 | Yonemoto | 187/113 |
| 4,346,788 | 8/1982 | Shung | 187/113 |
| 4,362,224 | 12/1982 | Fairbrother | 187/113 |
| 4,434,875 | 3/1984 | Scarzella | 187/110 |
| 4,515,247 | 5/1985 | Caputo | 187/113 |
| 4,520,904 | 6/1985 | Rado et al. | 187/113 |
| 4,534,452 | 8/1985 | Ogasawara et al. | 187/110 |
| 4,570,755 | 2/1986 | Tsai et al. | 187/113 |
| 4,785,915 | 11/1988 | Shah et al. | 187/110 |
| 4,787,481 | 11/1988 | Farrar et al. | 187/110 |

*Primary Examiner*—Philip H. Leung
*Assistant Examiner*—W. E. Duncanson, Jr.
*Attorney, Agent, or Firm*—White & Case

[57] ABSTRACT

A hydraulic elevator includes level sensors for establishing dead zones of different sizes and for changing the dead zone while the car is stopped at a floor. A controller selects the size of the dead zone, for purposes of relevel operations, based upon elevator operating state (e.g. doors open or closed, time of day, time since last run) or other parameters (excess oil temperature, motor temperature, or excess motor starts). The controller also selects an effective hysteresis value either to return the car to floor level or to move the car to a position above floor level. In this manner, the controller maintains a small dead zone, and returns the car to level, when the doors are open. When the doors are closed, a larger dead zone is selected to reduce the frequency of relevel operations. Moreover, under certain conditions, the car is moved, during releveling, to a position above the landing, to further reduce the number of required relevel operations over time.

14 Claims, 5 Drawing Sheets

25
12

11
10
CAR
19
40
18
32
38
34
36
31
CONTROLLER
26
19
16
24
LU
LD
LEVELING
UP SSOL
VALVE
DN SSOL
14
30
28
P
MOT ST
22
TANK
21
20

FIG. 4a
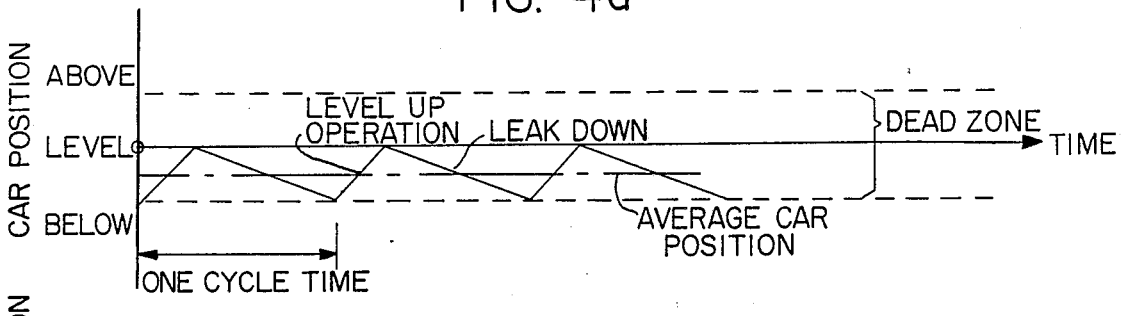
FIG. 4b
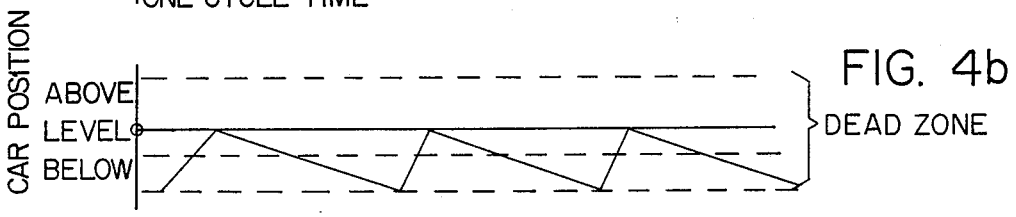
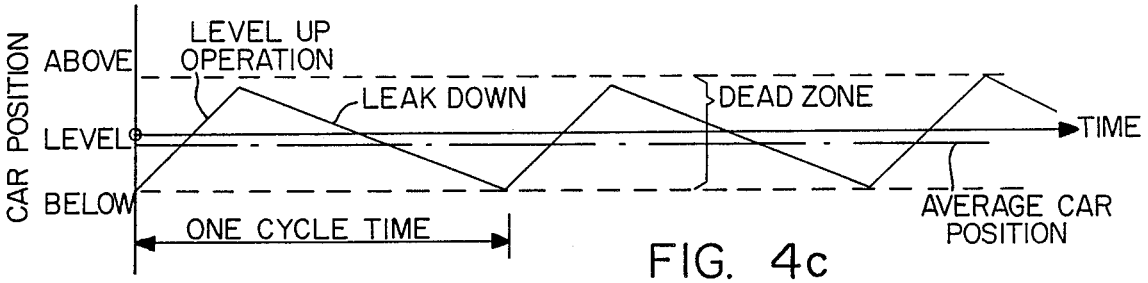
FIG. 4c
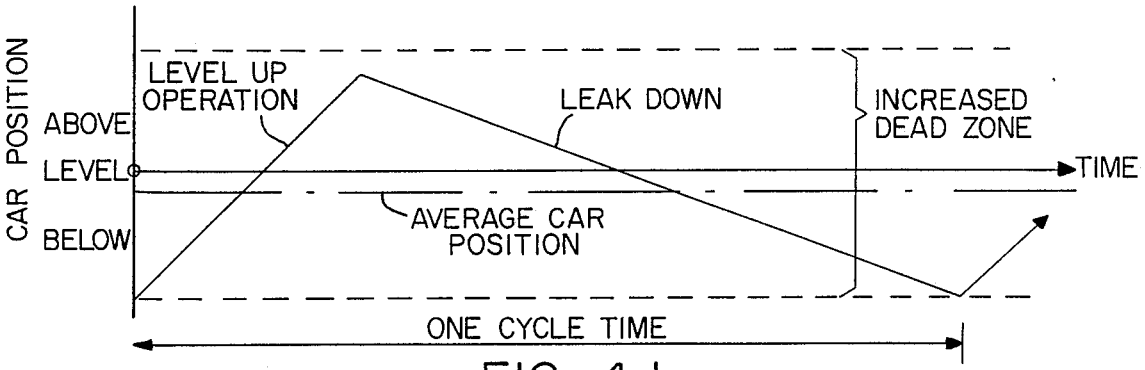
FIG. 4d

LEVELING CONTROL SYSTEM FOR HYDRAULIC ELEVATOR

FIELD OF THE INVENTION

The invention relates to hydraulic elevator systems, and particularly to an improved leveling control system for use in hydraulic elevators.

BACKGROUND OF THE INVENTION

In a hydraulic elevator, the car is supported by a hydraulic jack, which is used to raise and lower the car between floors. To raise the car, a pump supplies oil to a hydraulic control valve, which directs pressurized oil into the jack to raise the car to the desired floor. Usually the same hydraulic control valve is used to lower the car. In this case, however, it is not necessary to start the pump, in that the valve merely vents oil from the plunger back to the tank.

For up runs, the valve, rather than the pump motor, is used to control car movement. When the pump motor, which is typically an AC induction motor, is started, the valve initially bypasses all of the oil from the pump back to tank. After the pump motor has essentially reached full speed, the valve reduces the amount of bypass so that part of the pressurized oil is directed toward the jack, causing the jack, and the car, to begin to rise. Thereafter, the valve normally reduces further the amount of bypass, directing more oil to the jack and thereby increasing car speed. This may be done either in discrete steps or using a variable control.

Because the car is supported by a column of oil, a car that is initially level with the floor may not remain level. Oil is compressible, and changes in load inside the car (as passengers enter and leave the car) can cause the car to move away from the landing. Oil in the column may cool when the car is parked at a landing, causing the oil to contract. Oil leakage can also cause the car to sink.

It is therefore necessary to provide a relevel function to prevent the car from moving more than a prescribed distance away from the landing. This is usually done by providing sensors that detect when the car has moved a certain distance away from the landing. If the car sinks more than a desired distance below the landing, a relevel up operation is carried out. If the car moves upwardly more than a prescribed distance, a level down operation is effected.

Re-level up operations are carried out in a manner similar to other up runs. The pump motor is accelerated to full speed, at which time the hydraulic valve directs a portion of the pressurized oil to the jack to return the car slowly back to level. Once the car is again level, the motor is deenergized and allowed to coast to a stop.

Thus, it is necessary to start the motor, and run it to full speed, every time a relevel is required in the up direction. Appreciable heat is produced in the motor during start because the average slip is very high. Since the motor runs for only a few seconds, the internal fan is ineffective to remove the heat produced during a start. Therefore, any condition that causes an excessive rate of releveling operations increases the likelihood of the motor overheating and eventually failing. Hydraulic pump motors are rated for a maximum number of starts per hour. This rate can easily be exceeded by cyclic releveling.

The low car speed required for releveling is obtained by supplying only a portion of the pressurized oil to the jack, and bypassing most of the pump output back to tank. The oil is heated during each bypass operation. As a result, the oil temperature is raised during each releveling operation. Higher oil temperatures can reduce the efficiency of the pump and thereby waste energy.

Current relevel systems utilize a pair of sensors located at set distances above and below the landing, which define a certain "dead zone". A typical distance of the dead zone is currently $\frac{7}{8}$ inch. If the car moves far enough from the landing to engage the upper or lower dead zone sensor, a releveling operation will be initiated.

The switches which initiate a relevel operation have a certain amount of hysteresis inherent in the construction. As a result, when the sensor causes actuation of the switch, and the car starts to move back towards level, the switch remains closed for a certain period of time. The delay, which may be the result of friction and inertia, will permit the car to keep moving toward level until it is some distance away from the sensor. Moreover, the start needle and stop needle on the hydraulic valve can be manually adjusted to produce an acceptable releveling operation for any reasonable hysteresis value. Thus, between the inherent hysteresis value of the releveling switch, and a manual adjustment of the hydraulic valve, the distance of movement during a relevel operation can be selected so that the car is returned to the floor level position. If the dead zone is subsequently made larger or smaller, however, the valve must either be readjusted or the hysteresis of the sensor must be changed.

As discussed above, changes in load in the car, a change in oil temperature, and leakage, may all cause the car to move away from the landing and initiate a relevel operation. If the sensor that initiated a level up operation has insufficient hysteresis the valve will begin to close again before the car has moved appreciably. Insufficient hysteresis in the leveling sensor can therefore contribute to cyclic releveling. Moreover, while a narrow dead zone is desirable from a performance standpoint, a narrow dead zone is also a major cause of excessive releveling.

SUMMARY OF THE INVENTION

The invention is an improved leveling system for a hydraulic elevator, which includes a control system that varies the size of the dead zone based on the elevator operating state or certain other parameters of the elevator, and also selectively varies the effective hysteresis, which is used to control the distance of car travel during a relevel operation, based upon the selected dead zone, the desired relevel target position, and optionally other parameters.

More particularly, in a hydraulic elevator according to the invention, sensors of various spacings are provided either on the car or at the floor landings to define a plurality of dead zones of varying distances. When the car is stopped at a floor, a controller selects a desired dead zone responsive to the current elevator operating state, and sets an effective hysteresis value as a function of the size of the dead zone and optionally a changeable relevel target position. A relevel operation is initiated if the car should move beyond the selected dead zone, with the hysteresis value being used to control the distance the car is moved during the relevel operation.

Preferably, the controller operates to select a hysteresis value to return the car to level during times of active use of the elevator, and a different hysteresis value, to move the car slightly above the floor level, during periods of inactive use to reduce the number of relevel cycles. Preferably also, the controller is self-adjusting, to correct over-leveling problems.

In a preferred embodiment, a hydraulic elevator system includes a car, a jack for raising and lowering the car between landings, a pump for supplying pressurized hydraulic fluid, and a hydraulic valve for selectively directing fluid from the pump to the jack for raising the car. A level up sensor is capable of detecting the car position relative to the landing at a plurality of relevel distances below floor level position, and a processor control selects a releveling target position responsive to at least one elevator operating parameter. The processor control selects an effective hysteresis value as a function of the size of the dead zone and the target releveling position, and optionally as a function of additional operating parameters such as oil temperature.

In one embodiment, the processor control selects at least two dead zones, a relatively small dead zone when the doors are open, and a larger dead zone when the doors are closed. The controller may set an even larger dead zone during periods of low use. The controller also selects one of at least two elevator releveling target positions, dependent upon elevator operating state, one level with the floor (active use) and one above floor level (inactive use), by selecting one of two hysteresis values: a first that will return the car to the floor level position, or a second that will move the car beyond floor level, to a position above the floor. The elevator operating state, i.e., active use state versus inactive use state, may be determined by time of day, or by time between elevator runs, or possibly by signal from the group controller indicating, e.g., that the car is on standby. The hysteresis value, which will determine distance of upward movement responsive to a relevel operation, may also be controlled as a function of oil temperature or viscosity.

The processor control may select the size of the dead zone based upon the operating state of the elevator, e.g., the position of the doors, and also based upon oil temperature, motor temperature, the time since last releveling, or the rate of motor starts. In addition, the hysteresis value can be corrected as a function of actuating the level down sensor.

For better understanding of the invention, reference is made to the following description of the preferred embodiments, taken in conjunction with the drawings accompanying the application.

FIGS. *2a* and *2b* are perspective and side views, respectively, of a leveling sensor unit using discrete position sensing elements;

FIGS. *3a* and *3b* are perspective and side views respectively, of a leveling sensor unit utilizing an analog output photoelectric position sensor;

FIG. *4a* is a graph showing a releveling operation according to the invention for a first car operating state;

FIG. *4b* is a graph showing releveling operations for a second car operating state;

FIG. *4c* shows a releveling operation for a third car operating according to the invention;

FIG. *4d* shows a releveling operation for a fourth car operating state; and

Figure 5:
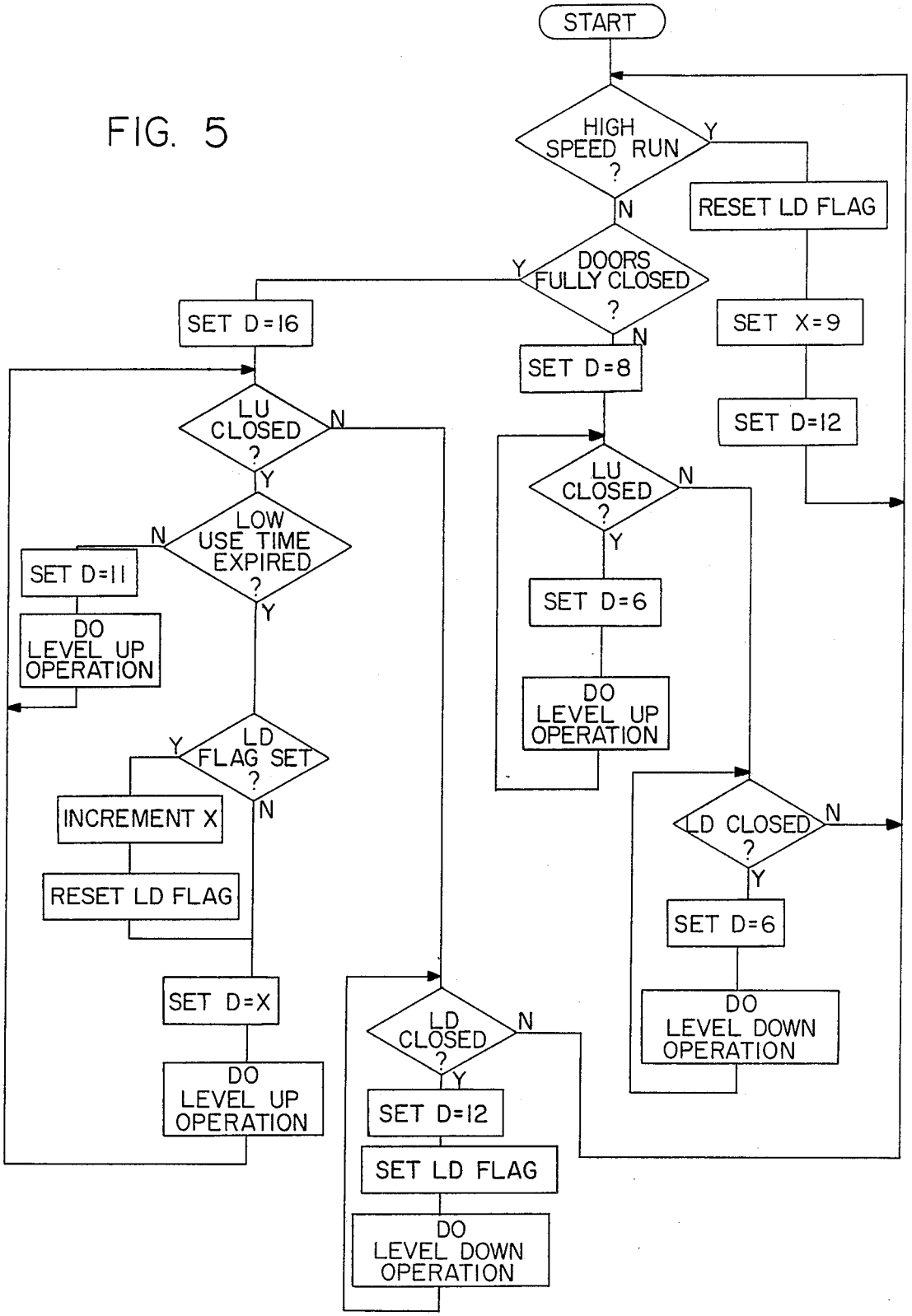

FIG. 5 is a flow chart showing a control program according to an exemplary embodiment of the invention.

DETAILED DESCRIPTION OF THE PREFERRED EMBODIMENTS

Figure 1:
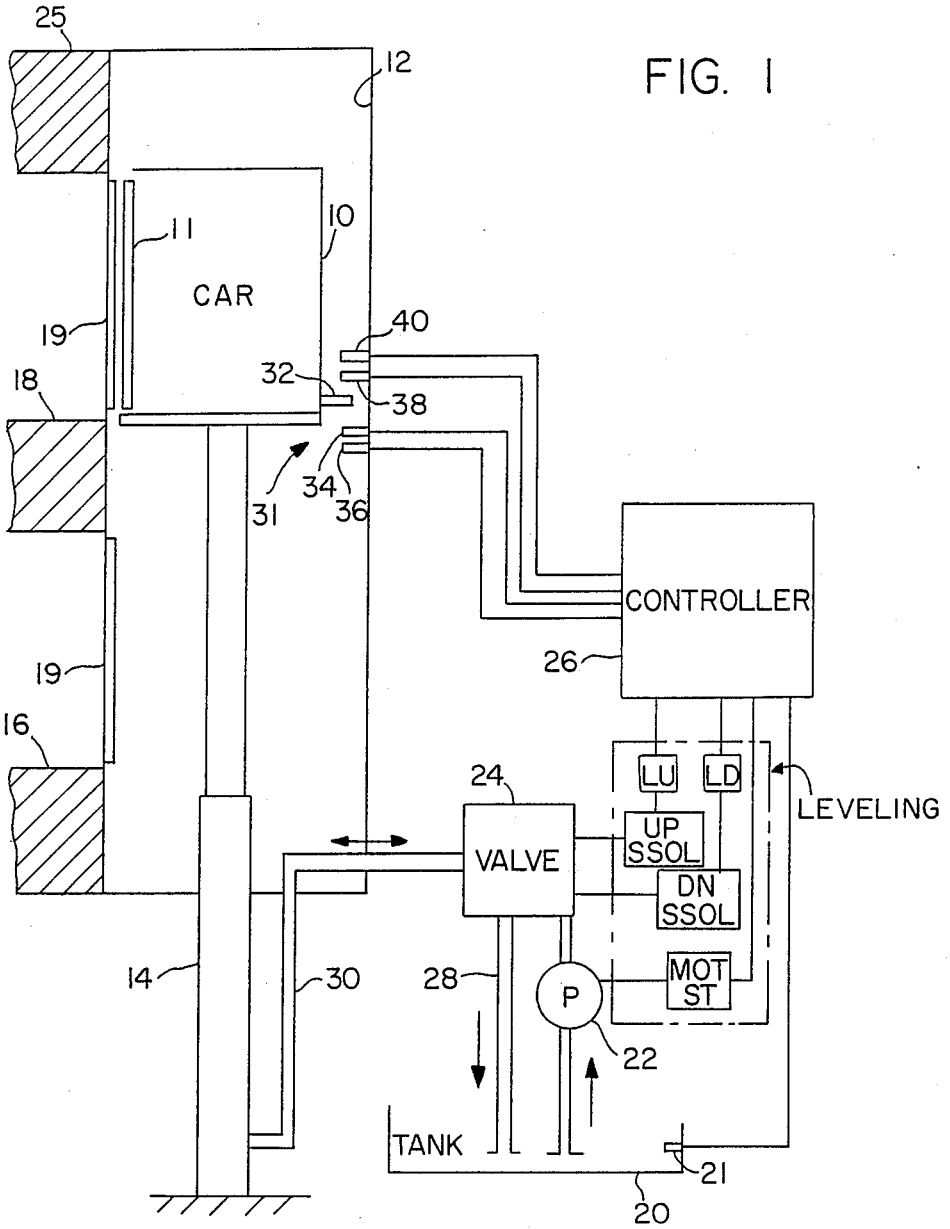
FIG. 1 is a schematic drawing of a hydraulic elevator incorporating a leveling control system according to the invention.

A hydraulic elevator is shown generally in FIG. 1. A car 10, having a door 11, is supported in a shaft 12 by a hydraulic jack 14. The car 10 is moveable between landings, 16, 18, which include hall doors 19.

Hydraulic fluid is stored in a tank 20, and selectively pumped by pump unit 22 to a hydraulic valve 24. The operation of valve 24 is controlled by a controller 26 for selectively raising and lowering the car. As shown in FIG. 1, valve 24 is connected to receive pressurized oil from the pump unit 22, to return oil to the tank through line 28, and to direct oil to and from the jack 14 through supply line 30.

As discussed above, in order to raise the car, the pump unit 22 is started, with oil initially bypassed to the tank through return line 28. Once the motor of pump unit 22, which is generally an AC induction motor, has reached essentially full speed, the valve 24 diverts pressurized oil, in a controlled manner, to the line 30 to raise the car at the desired rate. For down movement, the valve 24 vents fluid in the jack and line 30 to the return line 28. Hydraulic valves for controlling car movement are well known and need not be described further here.

FIG. 1 also shows part of a leveling circuit which, also being well known, will be described only generally. For up leveling, the controller is connected to a level up switch LU, which in turn is connected an up slow solenoid UP SSOL, which actuates valve 24 to divert part of the oil from pump 22 to the jack (the remainder continues to be bypassed) to slowly raise the car.

Controller 26 is also connected to a motor start switch MOT ST to start the pump. For level down, controller 26 is connected to a level down switch LD, which in turn is connected to down slow solenoid DN SSOL, which in turn is connected to valve 24. This circuit is only illustrative, and would in practice depend upon the particular type valve and other control circuitry employed.

Leveling sensor units, mounted between the car and building, are well known. Unlike known units, however, which are set for a fixed dead zone, the present invention incorporates a leveling unit which is able to detect car position away from the landing at multiple level up positions, and preferably at multiple level down positions, and includes a control that can select the size of the dead zone and vary it in the course of elevator operation, while the car is stopped at a floor.

For purpose of illustrating the invention, FIG. 1 shows a leveling vane 32 on car 10, and a pair of a level up sensors 34, 36 mounted in the shaft. The sensors 34, 36 are positioned at two different releveling distances below the vane 32 when the vane 32 and car 10 are at the floor level position shown at FIG. 1. Similarly, a pair of level down sensors 38, 40 are positioned at a plurality of releveling distances above the floor level position of the vane 32. The outputs of sensors 34, 36, 38 and 40 are connected to the controller 26.

FIGS. *2a* and *2b* illustrate another example of a level sensing unit 131, in which a vane 132 is mounted via brackets 133 to the rail or building structure. A level up unit 134 includes multiple photoelectric sensors 136 which are blocked in sequence by the vane as the car moves below floor level. Thus, car position can be detected at a plurality of distances away from the landing. Similarly, a level down sensing unit 138 includes multiple photoelectric sensors 140 which are blocked in sequence by movement of the car above floor level position. The level up sensing unit 134, the level down sensing unit 138, as well as a door zone sensor 142, may be mounted on a bracket 144 that includes variable positioning slots 146 for attachment to the car.

Figure 3A:
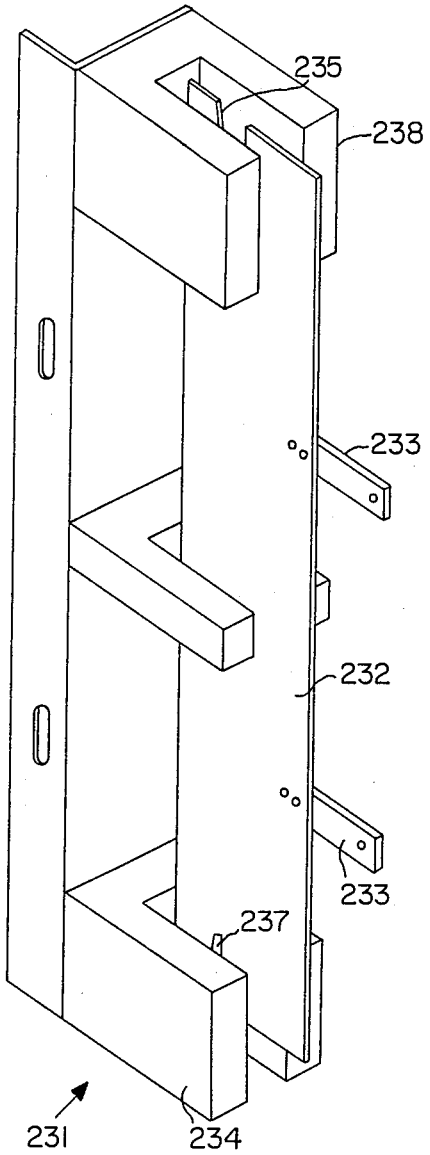
Figure 3B:
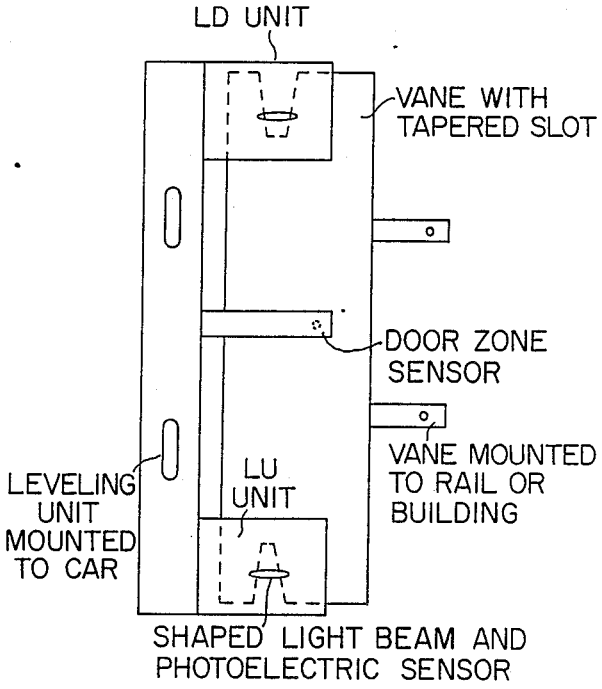

FIGS. 3*a* and 3*b* illustrate another example of a level sensing unit 231 for establishing multiple dead zones. A vane 232, which is attached to the rail or building by brackets 233, includes a pair of tapered slots 235, 237 at the upper end lower ends thereof. A level up unit 234 and a level down unit 238 are provided in vertical alignment with the tapered slots. The level up and level down units 234, 238 each include a light beam and photoelectric sensor which are disposed on opposite sides of the slot 235, 237, such that the amount of light passing through the slot and reaching the photoelectric sensor is a function of the position of the car. Preferably, the analog outputs of the level up and level down photoelectric sensors are converted to digital outputs by an analog-to-digital converter to give a multitude of discrete outputs indicative of the distance the car is off level.

As shown in FIG. 1, the output from the level up and level down sensors, either in the form of discrete sensor outputs, or position-dependent variable outputs (FIGS. 3*a* and 3*b*), is directed to the controller 26 and utilized as described below. The position information may be input to a microprocessor in controller 26 in the form an 8 bit digital number either in parallel or in series transmission.

Figure 2A:
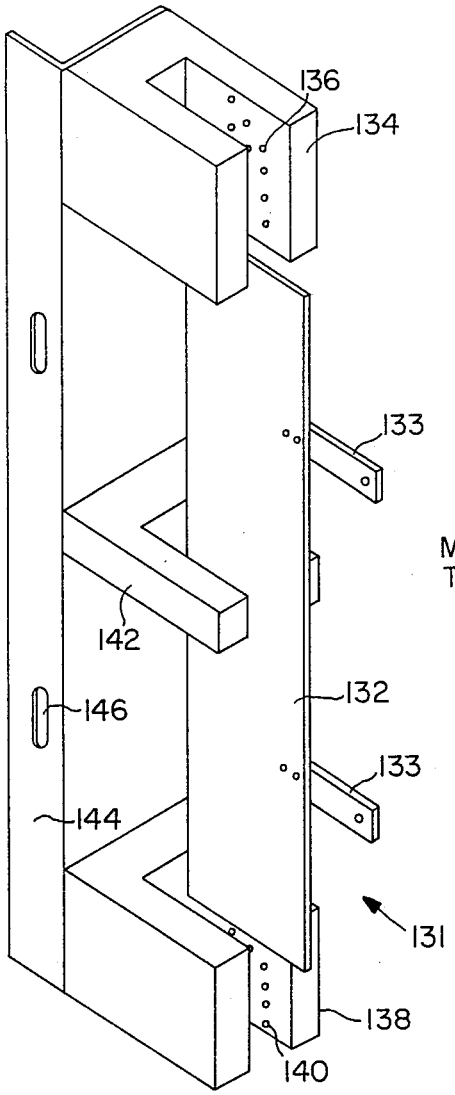
Figure 2B:
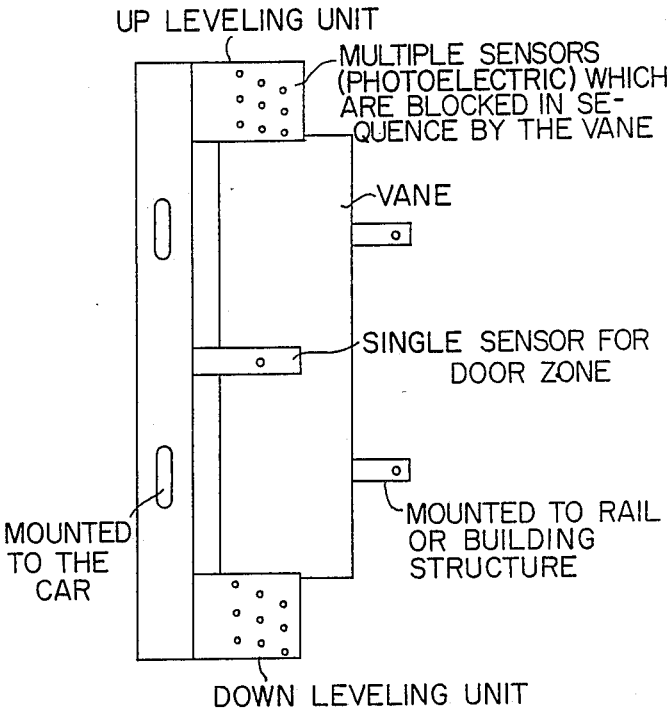

The controller 26 includes a processor, preferably a microprocessor, that has operating programs in memory to allow it to select a dead zone, such as ½ inch, ¾ inch, or 1 inch to either side of floor level. In the case of FIGS. 1–2, the controller 26 may set the dead zone by selecting a pair of photoelectric sensors 136 spaced at the desired distances above and below the landing. In the case of FIGS. 3, the controller selects the value from the units 234, 238, representing the desired distances away from the landing.

The size of the dead zone is preferably selected based on operating conditions such as the position of the car and hall doors (fully closed, commanded to open, open), the time since the last relevel function, time of day, or the length of time since the last car run or since door closing. The size of the dead zone may also be increased based on certain override parameters such as excess oil temperature, excess motor temperature, or excess motor starts.

The controller monitors the relevant external operating parameters, such as oil temperature, motor temperature, and the position of the doors. Where rate of motor starts is used as a control parameter, the controller is programmed to store in memory the number of motor starts and periodically calculate the rate of motor starts over time. The controller also includes a clock for monitoring time of day, the time since the last relevel function, and the length of time since the car last ran or closed its doors, if such parameter are to be used.

Once the dead zone has been selected, the effective hysteresis will be selected. The hysteresis value determines how far the car will be moved if a relevel operating is commenced. The selected hysteresis value, then, will be based on the size of the dead zone (because, e.g., with a larger dead zone, if the car moves sufficiently to actuate a level sensor, it will be further away from the floor than in the case of a smaller dead zone and therefore needs to be moved further to be returned to floor level), and the desired relevel target position, i.e., the desired position of the car after completion of the relevel function. The effective hysteresis may also be adjusted as a function of the temperature or viscosity of the oil. Preferably, the effective hysteresis value is also a function of the direction of the previous leveling operating in the event there has been no high speed run. In this manner, the microprocessor is self correcting, in that if the car levels up and then immediately initiates a level down operation, the next time it is programmed not to go up as far.

In selecting the effective hysteresis, the controller may return the car either to floor level position or, in certain instances, to a position above floor level. During periods of active use, the leveling control will preferably select an effective hysteresis so as to return the car to exactly level with the landing sill. When the car is parked during inactive periods, with the doors fully closed, it is preferable to have a level operation which causes the car to land at a point within the dead zone but some distance above the floor. This feature will cause the average car position to be closer to level, and will reduce the frequency of relevel operations.

When a car is stopped at a floor, the leveling function is activated. Depending upon the car operating state, the controller selects a particular level up and level down sensor, in the case of FIGS. 1 or 2, or a set of car position values in the case of FIGS. 3*a* to 3*b*. If the car should thereafter move downwards and activate the selected level up sensor, the controller 26 selects a desired effective hysteresis value, as described above, and then actuates the motor start switch MOT ST and level up switch LU to initiate a level up operation. The controller will maintain the switch LU closed for length of up travel determined by the effective hysteresis value, as well as the mechanical hysteresis, so as to return the car to the desired position.

By way of example, the effective hysteresis value may be used to select a second level up sensor, a predetermined distance closer to the floor than the dead zone level up sensor. If the dead zone level up sensor is activated, and a relevel is commenced, the controller switches to the second level up sensor. The controller will then continue to detect that the car is below the dead zone, and continue to move the car upwardly, until it reaches the second level up sensor, wherein the controller acts to stop the upward movement. By this time, the car will be moving fast enough so that when it finally comes to a stop (as determined by the mechanical hysteresis in, e.g., the valve 24) it will be returned to level (or to a desired position above the floor). In the case of the car actuating the level down sensor, the controller would actuate the level down switch, and employ the hysteresis value, in a similar manner.

In one embodiment, discussed further in connection with FIG. 4, the controller microprocessor includes three stored dead zones. In normal operation, the microprocessor selects the smallest dead zone at such time as the doors are open at a floor, and selects a larger dead zone when the doors are closed. At times of inactive use (e.g., night or after a predetermined idle time), the processor may switch to an even larger dead zone. Moreover, in the event that the controller detects excess oil temperature, excess motor temperature, or an excess rate of motor starts, the controller may switch to a larger dead zone.

The effective hysteresis is a function of the size of the dead zone. In the exemplary embodiment, one hysteresis value, sufficient to return the car to floor level, is selected during periods of active use. A larger value, which will cause the car to overshoot the floor and stop above floor level, is selected during periods of inactive use.

The operation of the leveling control according to I the invention is illustrated in FIGS. 4*a*–4*d* for various car operating states. FIGS. 4*a* illustrates the leveling function with the car at a floor and the doors open. As shown, the dead zone is relatively small, and the car, upon sinking to the level up position, is returned level with the sill. In this operating mode, the cycle time is relatively short and the number of relevels per hour is relatively high.

FIG. 4*b* illustrates an operating mode with the car at a floor and the doors closed, during active use of the elevator. The car is still relevelled to a position even with the sill, but as shown, the dead zone selected by the controller is larger than in the case of FIG. 4*a*. Accordingly, it takes longer for the car to sink to the level up position, the relevel cycle time is longer, and the number of releveling operation per hour is lower.

FIGS. 4*c* and 4*d* illustrate two operating conditions in which the doors are closed and the car is inactive. FIGS. 4*c* and 4*d* may represent operation during two different times of the day, for example business hours versus evening or night hours. FIG. 4*d* represents a larger dead zone for periods when the elevator is infrequently used, and a longer delay in releveling, when the doors are to open, can be tolerated. In each instance, when the level up sensor is activated, and the controller executes a relevel cycle, the controller selects an effective hysteresis that raises the car to a position above floor level, but still within the dead zone. As shown, the average car position in the case FIGS. 4*c* and 4*d* is closer to level than in the case of FIGS. 4*a* and 4*b* (even though the dead zone size is the same in FIGS. 4*b* and 4*c*). The cycle time is also considerably longer, and consequently the number of relevel operations per hour is substantially lower.

FIG. 5 is a flow chart of an exemplary leveling program for the controller 26, that will now be described. As indicated, while the car is executing a run between floors, the program resets a level down flag, and resets the values of X and D. X and D represent two initial dead zone positions. The initial value of D may be used for stopping the elevator car during a run level with the floor.

Once the car is stopped at a landing, the controller determines whether the doors are open or closed. If the doors are open, the controller sets a small dead zone D, which selects a level up sensor LU and a level down sensor LD relatively close to the landing (i.e., D=8 corresponds to the sensor pair that is selected). In the event that the selected sensor LU or LD is activated, the controller sets a smaller value of D selecting a new level up sensor LU and level down sensor LD closer to the floor (the difference between the original value of D and the new value D representing the effective hysteresis). Thereafter the controller executes a level up or down operation in which the valve is opened until the car reaches the new sensor LU or LD. Upon reaching the new sensor, the level up or level down switch is deactivated and the valve is closed. The car will continue to move for a distance depending upon the mechanical hysteresis in the valve.

In the "doors open" example of FIG. 5, which corresponds to FIG. 4*a*, a relevel is initiated when the car is at a position D=8, and a valve close signal is generated when the car has moved to a position D=6, i.e., before the car has been returned to level. The effective hysteresis is such that the close valve signal is generated at a point where the remaining car movement, due to the mechanical hysteresis in the valve, will return the car to floor level.

Returning to FIG. 5, if the car is stopped at a landing and the doors are closed, the controller sets a higher value of D, which selects sensors LU and LD farther away from the landing and in effect establishes a larger dead zone. If the selected level up sensor is activated, the controller determines the length of time during which the doors have been closed. If the doors have been closed for only a short period of time, indicating that the elevator is in active use (low use time has not expired), the controller sets a value of D, representative of effective hysteresis, to return the car to floor level, as in FIG. 4*b*. If the low use time, however, has expired, indicating that the car is probably in after hours operation, the controller will return the car to a position above floor level, as in FIG. 4*c*. The controller first determines if the level down flag has been set. In the event that the flag has not been set since the last high speed run, the value D is set at X and a relevel operation is commenced. With the value X set and relevel underway, the car moves toward the floor until it reaches the position corresponding to D=X, where the LU switch is opened. Because the value X is closer to the floor than the value of D utilized to relevel to floor level, the car continues to move upwardly due to valve hysteresis, and stops at a position above the floor.

If the level down flag has been set, it indicates that the last level up operation moved the car too high (i.e., the value X did not stop the level up operation soon enough). Accordingly, the value X is incremented, meaning that a smaller hysteresis value is used and the relevel operation will cut off sooner. In this manner, the level up cycle is self correcting.

When the doors are closed, if the level down sensor is activated, a value D is selected which will relevel the car to floor level, the level down flag LD is set, and down operation is commenced.

In the foregoing control program, the position of the level up and level down sensors is effectively changed to vary the size of the dead zone for different elevator operating conditions. In addition, when a relevel operation is commenced, the value D is moved a selected amount closer to the floor, such that the relevel operation continues for a predefined distance (effective hysteresis) depending upon the relevel target position, i.e., floor level or above floor level. In the foregoing example, the size of the dead zone, and the effective hysteresis value established by the controller, are a function of the position of the doors (open versus closed) and a function of operating state of the elevator (active use versus inactive use), as determined by the low use time determination. The effective hysteresis value is also a function of overshoot, in that the value is reduced if a relevel moves the car too high. As discussed above, however, in setting the value of D either to establish the size of the dead zone, or set an effective hysteresis value, the value may also be varied based upon other conditions or operating parameters, e.g., oil temperature, motor temperature, rate of motor starts, or time of day. Such factors may be used in the example of FIG. 5, as adjustments to the value of D for setting the position of the dead zone sensors and setting the effective hysteresis for relevel.

The foregoing is exemplary of a hydraulic elevator system according to the invention. Variations and modifications of the embodiments shown and described will be apparent to persons skilled in the art, without departing from the inventive principles enclosed herein. Various types of leveling sensors and detectors are known to persons skilled in the art, and any such systems may be employed in accordance with the present invention, provided that such sensors can select different leveling distances. In addition, while an example of the releveling controller and hydraulic valve have been described, the invention may be employed with any hydraulic valve and leveling circuit. Further, while an example has been given as to how the effective hysteresis value can be used to control the distance of relevel movement, other controls, which move the car to a target relevel position as a function of a selected hysteresis value, may be employed. All such modifications and variations are intended to be within the scope of the invention, as defined in the following claims.

I claim:

1. A hydraulic elevator system comprising:

a car;

a plurality of landings;

jack means for raising and lowering the car between landings;

pump means for supplying pressurized hydraulic fluid;

a hydraulic valve for selectively directing fluid from said pump means to said jack means for raising said car;

level up sensing means for detecting car position at a plurality of selected releveling distances below floor level position; and processor control means (a) for changing releveling distance responsive to at least one elevator operating parameter; (b) for selecting an effective hysteresis value as a function at least of releveling distance; (c) for actuating said pump means responsive to the actuation of said level up sensing means; and (d) for actuating said hydraulic valve responsive to the actuation of said level up sensing means for a distance dependent upon said effective hysteresis value.

2. A hydraulic elevator system as defined in claim 1, wherein said processor control means includes means for selecting at least two elevator releveling target positions, and means for selecting the effective hysteresis value as a function, in addition to releveling distance, of the desired elevator releveling target position.

3. A hydraulic elevator system as defined in claim 2, wherein the means for selecting releveling target position is responsive to elevator operating state.

4. A hydraulic elevator system as defined in claim 1, 2, or 3, comprising means for measuring oil temperature, and wherein said processor control means includes means for selecting the effective hysteresis value additionally as a function of oil temperature.

5. A hydraulic elevator system as defined in claim 1, 2, or 3, comprising means for measuring oil viscosity, and wherein said processor control means includes means for selecting the effective hysteresis value additionally as a function of oil viscosity.

6. A hydraulic elevator system as defined in claim 1, 2, or 3 comprising level down sensing means actuated responsive to car position at a selected distance above floor level position; wherein said processor control means includes means for detecting actuation of said level down sensing means following up releveling and for reducing the effective hysteresis value in subsequent up releveling operations responsive thereto.

7. A hydraulic elevator system as defined in claim 6, wherein said level down sensing means is actuated at one of a plurality of distances above floor level position, and said processor control means includes means for selecting said distance responsive to at least one elevator parameter.

8. A hydraulic elevator system as defined in claim 1, comprising means for measuring oil temperature and wherein said at least one operating parameter includes oil temperature.

9. A hydraulic elevator system as defined in claim 1, comprising means for measuring motor temperature, and wherein said at least one operating parameter includes motor temperature.

10. A hydraulic elevator system as defined in claim 1, wherein said car includes at least one door and door control means for selectively opening and closing said door, wherein said processor control means includes means for determining the operating state of said door control means, and wherein said at least one operating parameter includes the door operating state.

11. A hydraulic elevator system as defined in claim 1, wherein said processor control means includes clock means, and said at least one operating parameter includes time since the last releveling.

12. A hydraulic elevator system as defined in claim 1, wherein said processor control means includes means for determining rate of motor starts, and wherein said at least one operating parameter includes current rate of motor starts.

13. A hydraulic elevator system as defined in claim 1, comprising means for determining at least two elevator operating states, one representative of active use and one representative of inactive use, and wherein said at least one operating parameter includes elevator operating state.

14. A hydraulic elevator as defined in claim 2, wherein the effective hysteresis selecting means includes means for selecting a first value for returning the car to floor level and a second value for returning the car to above floor level.

* * * * *